United States Patent [19]

Walley

[11] Patent Number: 4,808,321

[45] Date of Patent: Feb. 28, 1989

[54] MONO-ESTERS AS FIBER AND FABRIC TREATMENT COMPOSITIONS

[75] Inventor: Darlene R. Walley, Cincinnati, Ohio

[73] Assignee: The Procter & Gamble Company, Cincinnati, Ohio

[21] Appl. No.: 45,975

[22] Filed: May 1, 1987

[51] Int. Cl.[4] ..... D06M 11/00

[52] U.S. Cl. ..... 252/8.8

[58] Field of Search ..... 252/8.8

[56] References Cited

U.S. PATENT DOCUMENTS

| | | | |
|---|---|---|---|
| 3,681,241 | 8/1972 | Rudy | 252/8.75 |
| 4,076,632 | 2/1978 | Davis | 252/8.8 |
| 4,128,485 | 12/1978 | Bauman et al. | 252/8.8 |
| 4,157,307 | 6/1979 | Jaeger et al. | 252/8.75 |
| 4,273,661 | 6/1981 | Grey | 252/8.8 |
| 4,339,391 | 7/1982 | Hoffman | 260/401 |
| 4,395,342 | 7/1983 | Strauss | 252/8.75 |
| 4,401,578 | 8/1983 | Verbruggen | 252/8.8 |
| 4,422,949 | 12/1983 | Ooms | 252/8.8 |
| 4,426,299 | 1/1984 | Verbruggen | 252/8.8 |
| 4,427,558 | 1/1984 | David | 252/8.8 |
| 4,439,330 | 3/1984 | Ooms | 252/8.8 |
| 4,454,049 | 6/1984 | MacGilp et al. | 252/8.8 |
| 4,476,031 | 10/1984 | Ooms | 252/8.8 |

FOREIGN PATENT DOCUMENTS

| | | |
|---|---|---|
| 0000406 | 1/1979 | European Pat. Off. . |
| 0018039 | 10/1980 | European Pat. Off. . |
| 1619043 | 4/1967 | Fed. Rep. of Germany . |
| 2829022 | 1/1980 | Fed. Rep. of Germany . |
| 2007734A | 10/1978 | United Kingdom . |
| 1601360 | 10/1981 | United Kingdom . |

*Primary Examiner*—John F. Niebling
*Assistant Examiner*—Isabelle Rodriguez
*Attorney, Agent, or Firm*—Jerry J. Yetter; George W. Allen; Richard C. Witte

[57] ABSTRACT

Disclosed are liquid fabric softening and antistatic compositions which contain mono-ester analogs of ditallow, dimethyl ammonium chloride type compounds as the active softening/antistatic agent. Such compositions have the active component dispersed as submicron particles in a liquid carrier. The pH of the compositions is maintained at 3.0±0.5, and the compositions are kept substantially free of amines in order to enhance the hydrolytic stability of the quaternary active.

9 Claims, No Drawings

MONO-ESTERS AS FIBER AND FABRIC TREATMENT COMPOSITIONS

TECHNICAL FIELD

The present invention relates to textile treatment compositions. In particular, it relates to textile treatment compositions for use in the rinse cycle of a textile laundering operation to provide fabric softening/static control benefits, the compositions being characterized by excellent storage stability and viscosity characteristics and biodegradability. The compositions herein can also be used to treat fabrics in hot air clothes dryers, and in hair conditioner compositions.

BACKGROUND

Textile treatment compositions suitable for providing fabric softening and static control benefits during laundering are well-known in the art and have found wide-scale commercial application. Conventionally, rinse-added fabric softening compositions contain, as the active softening component, substantially water-insoluble cationic materials having two long alkyl chains. Typical of such materials are di-stearyl di-methyl ammonium chloride and imidazolinium compounds substituted with two stearyl groups. These materials are normally prepared in the form of a dispersion in water and it is generally not possible to prepare such aqueous dispersions with more than about 10% of cationic materials without encountering intractable problems of product viscosity and stability, especially after storage at elevated temperatures, such that the compositions are unpourable and have inadequate dispensing and dissolving characteristics in rinse water. This physical restriction on softener concentration naturally limits the level of softening performance achievable without using excessive amounts of product, and also adds substantially to the costs of distribution and packaging. Accordingly it would be highly desirable to prepare physically-acceptable textile treatment compositions containing much higher levels of water-insoluble cationic softener materials.

It would also be desirable to have fabric softeners which are storage-stable, but which are biodegradable. However, materials which may be biodegradable are often insufficiently stable to formulate as liquid compositions.

It is an object of this invention to provide storage-stable, biodegradable fabric softeners. It is a further objective to provide such materials in the form of liquid products, concentrates, and in sheet form for use in clothes dryers. These and other objects are obtained herein, as will be seen from the following disclosure.

BACKGROUND ART

Cationic softener materials are normally supplied by the manufacturer in the form of a slurry containing about 70%–80% of active material in an organic liquid such as isopropanol, sometimes containing a minor amount of water (up to about 10%). Retail fabric softening compositions are then prepared by dispersion of the softener slurry in warm water under carefully controlled conditions. The physical form and dispersibility constraints of these industrial concentrates, however, are such as to preclude their direct use by the domestic consumer; indeed, they can pose severe processing problems even for the industrial supplier of retail fabric softening compositions.

Compounds analogous to those employed in the practice of this invention, but with somewhat shorter, branched alkyl chains (R′ hereinafter) and somewhat longer ester alkyl chains (R‴ hereinafter) than those selected for use herein are available under the tradename SYNPROLAM FS from ICI; see also U.S. Pat. No. 4,339,391, Hoffmann, et al, July 13, 1982. However, the desirable fabric softener/viscosity/stability/biodegradability properties of the specific compounds used herein as fabric treatment compositions when formulated in the manner disclosed herein do not appear to have been appreciated heretofore.

U.S. Pat. Nos. 4,426,299, Jan. 17, 1984, and 4,401,578, Aug. 30, 1983, to Verbruggen, relate to paraffin, fatty acids and ester extenders for softener concentrates.

European Pat. No. 0,018,039, Clint, et al, Mar. 7, 1984, relates to hydrocarbons plus soluble cationic or nonionic surfactants in softener concentrates to improve viscosity and stability characteristics.

U.S. Pat. No. 4,454,049 MacGilp, et al, June 12, 1984, discloses liquid textile treatment compositions in the form of isotropic solutions comprising water-insoluble di-$C_{16}$–$C_{24}$ optionally hydroxy-substituted alkyl, alkaryl or alkenyl cationic fabric softeners, at least about 70% of the fabric softener consisting of one or more components together having a melting completion temperature of less than about 20° C., a water-insoluble nonionic extender, especially $C_{10}$–$C_{40}$ hydrocarbons or esters of mono- or polyhydric alcohols with $C_8$–$C_{24}$ fatty acids, and a water-miscible organic solvent. The concentrates have improved formulation stability and dispersibility, combined with excellent fabric softening characteristics.

U.S. Pat. No. 4,439,330, Ooms, Mar. 27, 1984, teaches concentrated softeners comprising ethoxylated amines.

U.S. Pat. No. 4,476,031, Ooms, Oct. 9, 1984, teaches ethoxylated amines, or protonated derivatives thereof, in combination with ammonium, imadazolinium, and the like materials. The use of alkoxylated amines, as a class, in softener compositions is known (see, for example, German Patent Applications Nos. 2,829,022 and 1,619,043 and U.S. Pat. Nos. 4,076,632 and 4,157,307).

U.S. Pat. No. 4,422,949, Ooms, Dec. 27, 1983, relates to softener concentrates based on DTDMAC, glycerol monostearate and polycationics. See also U.K. 59502, June 26, 1985, to Turner and Dovey.

In the United Kingdom Application No. 2,007,734A, fabric softener concentrates are disclosed which contain a mixture of a fatty quaternary ammonium salt having at least one $C_8$–$C_{30}$ alkyl substituent and an oil or substantially water-insoluble compound having oily/fatty properties. The concentrates are said to be easily dispersed/emulsified in cold water to form fabric softening compositions.

Concentrated dispersions of softener material can be prepared as described in European Patent Application No. 406 and U.K. Pat. No. 1,601,360 by incorporating certain nonionic adjunct softening materials therein.

As can be seen, the specific problem of preparing fabric softening compositions in concentrated form suitable for consumer use has been addressed in the art, but the various solutions have not been entirely satisfactory. It is generally known (for example, in U.S. Pat. No. 3,681,241) that the presence of ionizable salts in softener compositions does help reduce viscosity.

SUMMARY OF THE INVENTION

The fiber- and fabric-softener and antistatic compounds used in the practice of this invention are of the general formula

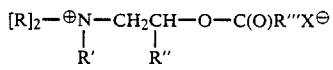

wherein each R substituent is a short-chain ($C_1$–$C_6$, preferably $C_1$–$C_3$) alkyl or hydroxyalkyl group, e.g., methyl (most preferred), ethyl, propyl, hydroxyethyl, and the like, or mixtures thereof; R′ is a long-chain hydrocarbyl substituent in the $C_{16}$–$C_{18}$ range, preferably $C_{18}$ alkyl, most preferably straight-chain $C_{18}$ alkyl; R″ is hydrogen (preferred) or a short-chain ($C_1$–$C_4$) hydrocarbyl substituent, especially methyl; and R‴ is a long-chain hydrocarbyl substituent in the $C_{13}$–$C_{15}$ range, preferably $C_{15}$ alkyl, especially straight-chain alkyl. The counterion $X^{\ominus}$ is not critical herein, and can be, for example, halide, methylsulfate, and the like. The preferred compounds can be considered to be monoester analogs of ditallow dimethyl ammonium chloride ("DTDMAC") which is a widely used fabric softener.

While not intending to be limited by theory, it is believed that the ester moiety lends biodegradability to these compounds, whereas the fact that only a single ester group is present provides sufficient hydrolytic stability that the compounds can be stably formulated as liquid compositions, under the conditions disclosed hereinafter. The desirable viscosity characteristics of the compounds which allows them to be formulated as concentrates are entirely unexpected. Since the compounds are cationic, they provide not only fiber and fabric softness, but also anti-static benefits.

The present invention encompasses liquid fabric softening and antistatic compositions, comprising: a liquid carrier; and at least about 1% by weight of a fabric softener compound of the above-disclosed formula dissolved or, preferably, dispersed in said carrier. Such liquid compositions are formulated at a pH of from about 2.0 to about 5.0, preferably 3±0.5, to provide good storage stability. For general laundry fabric softening use in a through-the-rinse mode, such compositions will typically comprise from about 3% to about 15% by weight of the softener compound.

The preferred liquid compositions herein have the softener compound present as particles dispersed in the carrier. The particles are preferably sub-micron size, generally having average diameters in the range of about 0.15–0.45 microns. Such particle dispersions can optionally be stabilized with emulsifiers.

Importantly, the liquid compositions herein are substantially free (generally, less than 1%) of free (i.e., unprotonated) amines, since free amines can catalyze decomposition of the softener compounds, on storage. However, if minor amounts of amines are present, they should be protonated with acid during formulation of the compositions. Strong acids, such as $H_3PO_4$ and HCl, can be used for this purpose.

The low viscosities exhibited by dispersions of particles of the compounds herein allows them to be formulated as water-dilutable fabric softener "high concentrates" which contain from about 16% to about 25% by weight of the fabric softener compound. Such high concentrates are conveniently packaged in pouches, which can be diluted with water to "single-strength" softeners (typically, 3–5% concentration of softener active) by the user.

The compounds herein can also be formulated as solids, for example, in combination with particulate carriers as particulate fabric softening and antistatic compositions. When formulated as solids, the pH and presence or absence of amines are, of course, not as critical as with the liquid compositions, since stability to hydrolysis on storage is not so problematic.

Other solid compositions herein have the compounds releasably affixed to sheet materials to provide fabric softening and antistatic compositions in sheet form which can be used in hot air clothes dryers.

The invention also encompasses a method of softening fibers (including hair) or fabrics, or imparting an antistatic finish thereto, comprising contacting said fibers or fabrics with a compound of the above-disclosed type.

All percentages, ratios and proportions herein are by weight, unless otherwise specified.

DETAILED DESCRIPTION OF THE INVENTION

The compounds used as the active softener and antistatic ingredient in the practice of this invention are prepared using standard reaction chemistry. In a typical synthesis, an amine of the formula $RR'NCH_2CHR''OH$ is esterified at the hydroxyl group with an acid chloride of the formula $R'''C(O)Cl$, then quaternized with an alkyl halide, RX, to yield the desired reaction product (wherein R, R′, R″ and R‴ are as defined in the above structural formula). Reference can be made to Example I, hereinafter, for a detailed disclosure of the synthesis of a preferred compound. However, it will be appreciated by those skilled in the chemical arts that this reaction sequence allows a broad selection of compounds to be prepared. As illustrative, nonlimiting examples there can be mentioned the following (wherein all long-chain alkyl substituents are straight-chain):

$[CH_3]_2[C_{18}H_{37}]^{\oplus}NCH_2CH(CH_3)OC(O)C_{15}H_{31}Br^{\ominus}$ $[C_2H_5]_2[C_{17}H_{35}]^{\oplus}NCH_2CH_2OC(O)C_{13}H_{27}Cl^{\ominus}$ $[C_2H_5][CH_3][C_{18}H_{37}]^{\oplus}NCH_2CH_2OC(O)C_{14}H_{29}SO_4^{\ominus}CH_3$ $[C_3H_7][C_2H_5][C_{16}H_{33}]^{\oplus}NCH_2CH_2OC(O)C_{15}H_{31}Cl^{\ominus}$ $[\text{iso-}C_3H_7][CH_3][C_{18}H_{37}]^{\oplus}NCH_2CH_2OC(O)C_{15}H_{31}I^{\ominus}$ Since the foregoing compounds are somewhat liable to hydrolysis, they should be handled rather carefully when used to formulate the compositions herein, especially liquid compositions. For example, stable liquid compositions herein are formulated at a pH in the range of about 2.0 to about 5.0, preferably about pH 3.0±0.5. The pH can be adjusted with standard acids, e.g., HCl, HBr, and the like; $H_3PO_4$ is preferred.

Moreover, the liquid compositions herein should be substantially free (1%, or less, preferably 0.3%) of amines. While many fully-formulated fabric softener compositions comprise mixtures of various softener compounds, the amine softeners sometimes used in such art-disclosed compositions are preferably not used in the liquid compositions of this invention, since they can catalyze hydrolysis and thereby reduce storage stability. However, it should be appreciated that the liquid and solid compositions herein can optionally contain non-amine softener and antistatic materials, e.g., standard softener "quats" such as ditallow dimethyl ammonium chloride ("DTDMAC"), $C_{14}$–$C_{18}$ imidazoliniums, etc., as auxiliary softener/antistat ingredients. Such optional ingredients can typically comprise 1%–10% of the present compositions.

The liquid compositions herein comprise a liquid carrier, which is typically water or a mixture of water and an alcohol such as ethanol or iso-propanol (typically 0.5–3.0% alcohol). The softener compounds used in this invention are insoluble in such water-based carriers and, thus, are present as a dispersion of fine particles therein. These particles are, as noted above, preferably sub-micron in size and are conveniently prepared by high-shear mixing which disperses the compounds as fine particles. Preparation of a preferred dispersion is disclosed in detail in Example II, hereinafter. Again, since the compounds are hydrolytically labile, care should be taken to avoid the presence of base and to keep the processing temperatures in the range of about 70° to about 80° C.

The particulate dispersions of the foregoing type can optionally be stabilized against settling by means of standard, non-base emulsifiers, especially nonionics such as the $C_{14-18}$ ethoxylates ($EO_{8-15}$), typically used at concentrations of 0.1–2%, according to known practice in the formulation of liquid DTDMAC fabric softener dispersions.

In the method aspect of this invention, fabrics or fibers are contacted with from about 3.0 g to about 9.0 g (per 3.5 kg of fiber or fabric being treated) of the compounds herein in an aqueous bath, or in a hot air clothes dryer. Of course, the amount used is at the discretion of the user, depending on fiber or fabric type, degree of softness desired, and the like. Typically, about 120 mls. of a 5% dispersion (see Example II) are used in a 25 l laundry rinse bath to soften and provide antistatic benefits to a 3.5 kg load of mixed fabrics.

The following examples illustrate the practice of this invention, but are not intended to be limiting thereof.

EXAMPLE I

Synthesis of the preferred fabric softener used herein is accomplished by the following two-step process:

Step A. Synthesis of Amine

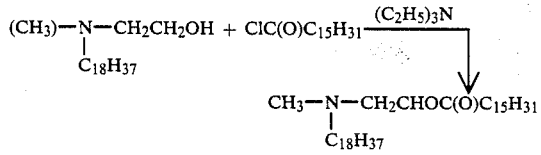

PROCEDURE 0.6 moles of octadecyl, ethanol, methyl amine are placed in a 3-liter, 3-necked flask equipped with a reflux condenser, argon (or nitrogen) inlet and two addition funnels. In one addition funnel are placed 0.4 moles of triethylamine and in the second addition funnel are placed 0.6 moles of palmitoyl chloride in a 1:1 solution with methylene chloride. Methylene chloride (750 mL) is added to the reaction flask containing the amine and heated to 35° C. (water bath). The triethylamine is added dropwise, and the temperature is raised to 40°–45° C. while stirring over one-half hour. The palmitoyl chloride/methylene chloride solution is added dropwise and allowed to heat at 40°–45° C. under inert atmosphere overnight (12–16 h).

The reaction mixture is cooled to room temperature and diluted with chloroform (1500 mL). The chloroform solution of product is placed in a separatory funnel (4 L) and washed with sat. NaCl, dil. $Ca(OH)_2$, 50% $K_2CO_3$ (3 times)*, and, finally, sat. NaCl. The organic layer is collected and dried over $MgSO_4$, filtered and solvents are removed via rotary evaporation. Final drying is done under high vacuum (0.25 mm Hg).

*Note: 50% $K_2CO_3$ layer will be below chloroform layer.

ANALYSIS

TLC (thin layer chromatography)**: solvent system (75% diethyl ether: 25% hexanes) Rf=0.7.

IR ($CCl_4$): 2910, 2850, 2810, 2760, 1722, 1450, 1370 $cm^{-1}$ $^1$H-NMR ($CDCl_3$): δ2.1–2.5 (8H), 2.1 (3H), 1.20 (58H), 0.9 (6H) ppm (relative to tetramethylsilane=0 ppm).

**10X20 cm pre-scored glass plates, 250 micron silica gel; visualization by PMA (phosphomolybdic acid-5% in ethanol) staining.

Step B: Quaternization

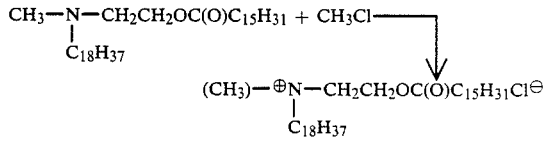

PROCEDURE 0.5 moles of the octadecyl, palmitoylethyl, methyl amine prepared in Step A are placed in an autoclave sleeve along with 200–300 mL of acetonitrile (anhydrous). The sample is then inserted into the autoclave and purged three times with He (16275 mm Hg/21.4 ATM.) and once with $CH_3Cl$. The reaction is heated to 80° C. under a pressure of 3604 mm Hg/4.7 ATM. $CH_3Cl$ and solvent is drained from the reaction mixture. The sample is dissolved in chloroform and solvent is removed by rotary evaporation, followed by drying on high vacuum (0.25 mm Hg). Both the $C_{18}H_{37}$ and $C_{15}H_{31}$ substituents in this highly preferred compound are n-alkyl.

ANALYSIS

TLC (5:1 chloroform:methanol)*: Rf=0.25.

IR ($CCl_4$): 2910, 2832, 1731, 1450 $cm^{-1}$.

$^1$H-NMR ($CDCl_3$): δ4.0–4.5 (2H), 3.5 (6H), 2.0–2.7 (6H), 1.2–1.5 (58H), 0.9 (6H) ppm (relative to tetramethylsilane=0 ppm).

$^{13}$C-NMR ($CDCl_3$): 172.5, 65.3, 62.1, 57.4, 51.8, 33.9, 31.8, 29.5, 28.7, 26.2, 22.8, 22.5, 14.0 (relative to tetramethylsilane=0 ppm).

*10X20 cm pre-scored glass plates, 250 micron silica gel; visualization by PMA staining.

EXAMPLE II

The preparation of a liquid fabric softener composition for use in the rinse cycle of a standard laundering operation is as follows.

| Ingredient | Amount (wt. %) |
|---|---|
| Softener Compound* | 5.0 |
| Isopropyl Alcohol** | 0.9 |
| Dye/Minors | 0.1 |
| Water | Balance |

-continued

| Ingredient | Amount (wt. %) |
|---|---|
| $H_3PO_4$ | to pH 2.0–5.0 |

*Prepared in Example I
**Optionally ranging 0.5–2.0%

The nonhydrolytic preparation of the composition of Example II is carried out as follows. The softener compound and the isopropyl alcohol are mixed and warmed (80° to 85° C.) to form a fluidized "melt". The melt is then poured into the water (70° to 80° C.) with high shear mixing (7000 rpm; 20–25 minutes) to submicronize the softener particles. The dye and minors are added, and the pH is adjusted with $H_3PO_4$. The resulting dispersion has a viscosity of about 40 centipoise and is used in standard fashion as a through-the-rinse fabric softener. All liquid compositions herein are prepared in substantially the same manner.

In the same manner, dispersions of the softener of Example I in water-isopropyl alcohol (90:10) at 8% (50 cps) and 15% (80 cps) are prepared.

In addition to the cationic softener component, the present compositions can be supplemented by all manner of optional components conventionally used in textile treatment compositions, for example, colorants, perfumes, preservatives, optical brighteners, opacifiers, viscosity modifiers, fabric conditioning agents, surfactants, stabilizers such as guar gum and polyethylene glycol, antishrinkage agents, antiwrinkle agents, fabric crisping agents, spotting agents, soil-release agents, germicides, fungicides, antioxidants such as butylated hydroxy toluene, anticorrosion agents, and the like.

In particular, materials such as DTDMAC, the $C_{16}$–$C_{18}$ dialkylimidazoliniums, polydimethylsiloxanes, glycerol monostearate, and, as noted above, emulsifiers, especially ethoxylated nonionics, can optionally be used in the present compositions. As noted, amines such as TAMET ($C_{18}H_{37}N[CH_2CH_2OH]_2$) can be present in relatively small amounts (typically, 0.3–0.5%) if in the protonated form.

Solid carrier materials can be used in place of liquids. For example, the softener compounds can be adsorbed on particulate solids such as potassium sulfate, micronized silica, and the like, and added to a laundry rinse bath. Alternatively, the softeners can be releasably padded onto a sheet (e.g., paper toweling, nonwoven fabric, or the like) and tumbled with damp fabrics in a hot-air clothes dryer, in the manner of the BOUNCE brand dryer-added product known in commercial practice. Generally, such solid-form compositions will comprise 80–99% carrier and 1–20% softener.

The following examples further illustrate the practice of this invention.

EXAMPLE III

A dryer-additive sheet is prepared by warming 5 g. of the softener compound of Example I in 6 g. isopropanol to prepare a melt in the manner of Example II. The melt is evenly spread onto and into an ordinary, disposable paper hand towel (20 cm×20 cm) and allowed to dry. In-use, the impregnated towel is commingled and tumbled with wet fabrics (5 kg load of fabrics, dry weight basis) in a standard hot air clothes dryer until the fabrics are dry, to provide a soft, antistatic finish.

EXAMPLE IV

A liquid fabric softener as a particulate, sub-micron dispersion is prepared according to Example II, and has the following composition:

| Ingredient | Percent (wt.) |
|---|---|
| DTDMAC | 2.0 |
| Softener compound* | 4.0 |
| $C_{11-15}$ alcohol $EO_{10}$ (avg) | 0.5 |
| Isopropyl alcohol | 7.5 |
| Water | Balance |
| $H_3PO_4$ | To pH 2.0–5.0 |

*Per Example I

EXAMPLE V

A particulate softener comprises the following.

| Ingredient | Percent (wt.) |
|---|---|
| Micronized silica | 90.0 |
| Softener compound* | 7.0 |
| $Na_2SO_4$ | 2.0 |
| $C_{11-15}$ alcohol $(EO)_{15}$ | 1.0 |

*$(CH_3)_2(C_{18}H_{37})^{\oplus}NCH_2CH_2OC(O)C_{14}H_{29}Br^{\ominus}$

The composition of Example V is prepared by co-melting the softener compound, ethoxylated alcohol, and an equal weight of ethanol, with gentle warming, then spraying the melt uniformly onto the particulate silica/sodium sulfate.

EXAMPLE VI

A high concentrate liquid fabric softener comprises the following.

| Ingredient | Percent (wt.) |
|---|---|
| Softener compound* | 20 |
| Isopropyl alcohol | 3.0 |
| Water | Balance |
| $H_3PO_4$ | To pH 2.0–5.0 |

*Per Example I

The composition of Example VI is prepared in the manner of Example II, as sub-micron particles suspended in liquid. In a convenient mode, the composition is packaged in a simple plastic pouch, which is opened and poured into 4X its volume of water prior to use to prepare a "single strength" softener composition, thereby saving on packaging and shipping costs and storage space.

The single strength composition prepared from the concentrate of Example VI can be applied to human or animal hair, typically after shampooing, to provide a soft, lubricious feel.

EXAMPLE VIII

A preferred liquid composition herein is as follows.

| Ingredient | Percent (wt.) |
|---|---|
| Softener compound* | 4.4 |
| TAMET | 0.3 |
| Glycerol monostearate | 1.2 |
| Polydimethylsiloxane fluid | 0.1 |
| Bronopol (preservative) | 100 ppm |
| $H_3PO_4$ | 0.07 |
| Dye/perfume | 0.26 ppm |
| Water | Balance |

-continued

| Ingredient | Percent (wt.) |
|---|---|
| Product pH** | 2.0–5.0 |

*Per Example I, fluidized with isopropanol
**Measured at 10% dilution

It will, of course, be appreciated by those skilled in the art of commercial syntheses that the amine feedstocks used herein may contain varying, small amounts of di-alcohol components, from which some di-esters may be formed. Moreover, it may be more economical, on a commercial scale, to prepare the esters herein using acids and appropriate catalysts, rather than acid chlorides. Such matters are well within routine commercial know-how, and do not depart from the spirit and scope of the present invention. Importantly, the preferred compounds herein function well at temperatures lower than many art-disclosed fabric softeners, making them more useful in hot air clothes dryers, as well as performing well when fabrics are line-dried.

What is claimed is:

1. A liquid fabric softening and antistatic composition, comprising:

(a) a liquid carrier; and dispersed therein, (b) at least about 1% by weight of submicron particles of a softener compound of the formula $$[R]_2-\overset{\oplus}{N}(R')-CH_2CH(R'')-O-C(O)R'''X^{\ominus}$$

wherein each R is a short-chain alkyl or hydroxyalkyl group, or mixtures thereof; R′ is a $C_{16}$–$C_{18}$ hydrocarbyl group, R″ is a hydrogen or short-chain hydrocarbyl group; R‴ is a $C_{13}$–$C_{15}$ hydrocarbyl substituent; and X is a counterion;

(c) said composition being formulated at a pH of about 3.0±0.5 and being substantially free of amines in order to enhance the hydrolytic stability of said softener compound.

2. A composition according to claim 1 wherein each R is $C_1$ to $C_3$ alkyl and R″ is hydrogen.

3. A composition according to claim 2 wherein each R′ is $C_{18}$ straight-chain alkyl.

4. A composition according to claim 3 wherein each R group is methyl, and R‴ is $C_{15}$ straight-chain alkyl.

5. A composition according to claim 1 which contains from about 3% to about 15% by weight of the softener compound.

6. A composition according to claim 1 wherein the particles have average diameter in the range of 0.2–0.45 microns.

7. A composition according to claim 5 which additionally contains an emulsifier.

8. A composition according to claim 6 wherein the softener compound is $$(CH_3)_2-\overset{\oplus}{N}(C_{18}H_{37})-CH_2CH_2OC(O)C_{15}H_{31}Cl^{\ominus}$$

9. A water-dilutable fabric softener high concentrate according to claim 1 which contains from about 16% to about 25% by weight of the fabric softener compound.

* * * * *